US011317670B2

(12) United States Patent
Davis

(10) Patent No.: US 11,317,670 B2
(45) Date of Patent: May 3, 2022

(54) INTERACTIVE THERAPEUTIC HEADWEAR

(71) Applicant: Inspire Create, LLC, Chula Vista, CA (US)

(72) Inventor: Shannon Marie Davis, Chula Vista, CA (US)

(73) Assignee: Inspire Create, LLC, Chula Vista, CA (US)

( * ) Notice: Subject to any disclaimer, the term of this patent is extended or adjusted under 35 U.S.C. 154(b) by 0 days.

(21) Appl. No.: 16/905,726

(22) Filed: Jun. 18, 2020

(65) Prior Publication Data

US 2020/0404997 A1 Dec. 31, 2020

Related U.S. Application Data

(60) Provisional application No. 62/866,502, filed on Jun. 25, 2019.

(51) Int. Cl.

| | |
|---|---|
| ***A42B 1/248*** | (2021.01) |
| ***A42B 1/004*** | (2021.01) |
| ***A42B 1/0186*** | (2021.01) |
| ***A42B 1/06*** | (2021.01) |
| *A42B 1/0182* | (2021.01) |

(52) U.S. Cl.

CPC ..... *A42B 1/004* (2013.01); *A42B 1/0186* (2021.01); *A42B 1/06* (2013.01); *A42B 1/248* (2013.01); *A42B 1/0182* (2021.01)

(58) Field of Classification Search

CPC ..... A42B 1/004; A42B 1/086; A42B 1/248; A42B 1/0182; A42B 1/0183; A42B 1/011; A42B 1/241; A61M 2021/0016; A61H 2201/102; A61H 2201/105

See application file for complete search history.

(56) References Cited

U.S. PATENT DOCUMENTS 3,212,495 A * 10/1965 Osbourn ..... A61B 10/0035 600/556
4,451,935 A * 6/1984 Henschel ..... A42B 1/241 2/181

(Continued)

FOREIGN PATENT DOCUMENTS

CN 2774206 Y 4/2006
CN 201384101 Y 1/2010

(Continued)

OTHER PUBLICATIONS

Hativity, Instagram, https://www.instagram.com/p/Bf4NIAOnyU4/, Post dated Mar. 3, 2018, accessed Sep. 22, 2021 (Year: 2018).*

(Continued)

*Primary Examiner* — Heather Mangine

(74) *Attorney, Agent, or Firm* — Procopio, Cory, Hargreaves & Savitch LLP

(57) ABSTRACT

Interactive therapeutic devices for wear on a head of a user are provided herein, along with kits including the interactive therapeutic device and an activity book, and methods of using the devices and kits. Contemplated devices comprise a set of attachment points that removably couple with a set of patches via fastener components. The patches can include various types of patches that provide different benefits to the wearer, including style, a scent, a noise, a tactile sensation, protection, and/or the ability to better communicate a feeling and/or a need.

11 Claims, 16 Drawing Sheets

(56) References Cited

U.S. PATENT DOCUMENTS 4,611,355 A * 9/1986 Galanto ..... A44C 3/001 2/246
4,710,979 A * 12/1987 Bull ..... A41B 13/10 2/48
4,776,043 A * 10/1988 Coleman ..... A42B 1/248 2/195.1
4,860,736 A * 8/1989 Kaitz ..... A61F 13/105 604/307
5,003,640 A 4/1991 Pizzacar
5,070,545 A * 12/1991 Tapia ..... A42B 1/248 40/329
5,107,548 A 4/1992 Dotzenrod
5,136,726 A * 8/1992 Kellin ..... A41D 27/08 2/115
5,253,368 A * 10/1993 Blake ..... A42B 1/248 2/195.1
5,359,733 A * 11/1994 Brannon ..... A42B 1/248 2/195.1
5,359,734 A * 11/1994 Rathburn ..... A42B 1/248 2/195.1
5,373,586 A * 12/1994 Brosnan ..... A42B 1/248 2/195.1
5,454,120 A * 10/1995 Rowlands ..... A42B 1/248 2/195.1
5,477,629 A * 12/1995 Gleason, Jr. ..... A42B 1/0188 40/329
5,509,144 A * 4/1996 Soergel ..... A42B 1/248 2/195.1
5,725,472 A * 3/1998 Weathers ..... A61M 21/0094 600/21
5,729,830 A * 3/1998 Luhtala ..... A42B 3/00 2/2.5
5,734,991 A * 4/1998 Schmid ..... A41D 27/08 2/1
5,740,557 A 4/1998 Reid et al.
5,862,523 A * 1/1999 Proctor ..... A42B 1/247 2/209.11
5,887,287 A * 3/1999 Potochnik ..... A42B 1/241 2/209.13
5,950,888 A * 9/1999 Nolan-Brown ..... A63H 33/006 224/172
5,957,692 A * 9/1999 McCracken ..... G09B 19/00 434/159
6,049,912 A 4/2000 Linehan
6,175,963 B1 * 1/2001 Loeffelholz ..... A43B 23/24 2/209.13
6,240,568 B1 6/2001 Lee
6,519,779 B1 * 2/2003 Taguchi ..... A42B 1/248 2/195.1
6,643,847 B1 * 11/2003 Dornak ..... A42B 1/0182 2/195.1
6,764,656 B1 * 7/2004 Matulevich ..... A61L 9/12 422/124
6,936,269 B2 8/2005 Robinson
D594,185 S * 6/2009 Lacy ..... D2/879
D619,336 S * 7/2010 Eyl ..... D2/866
D619,788 S * 7/2010 Lacy ..... D2/879
7,815,878 B1 * 10/2010 Wheatley ..... A63B 43/00 422/306
7,914,290 B2 * 3/2011 Yoon ..... G09B 1/00 434/260
8,196,225 B1 * 6/2012 Nicks ..... A41D 27/08 2/244
8,869,312 B2 10/2014 Tuohy et al.
D751,794 S 3/2016 Zenoff
D751,795 S 3/2016 Zenoff
D764,771 S 8/2016 Zenoff
D764,772 S 8/2016 Zenoff
9,603,402 B2 3/2017 Warner et al.
9,655,396 B1 * 5/2017 Lacy ..... A42B 3/067
10,226,091 B2 * 3/2019 Cowan ..... A41D 27/201
11,110,258 B1 * 9/2021 Collins ..... A61M 35/10
2001/0034894 A1 * 11/2001 Godfrey ..... A42B 1/248 2/209.13
2004/0068778 A1 * 4/2004 Van Veghel ..... A41D 27/08 2/244
2006/0143791 A1 * 7/2006 Kronenberger ..... A42B 1/248 2/195.1
2007/0158455 A1 * 7/2007 Robbins-Sullivan ... A61L 9/042 239/34
2007/0186327 A1 * 8/2007 Hall ..... A44B 18/00 2/69
2008/0086793 A1 * 4/2008 Higgins ..... A42B 1/248 2/209.13
2009/0144882 A1 6/2009 Neri
2009/0210994 A1 * 8/2009 Cicchinelli ..... A42B 1/24 2/209.12
2009/0265837 A1 * 10/2009 Cunliffe ..... G06Q 30/0241 2/244
2009/0294499 A1 12/2009 McKinney et al.
2009/0300820 A1 12/2009 Cansler et al.
2010/0058510 A1 * 3/2010 Vithlani ..... A41D 27/08 2/69
2010/0058511 A1 * 3/2010 Lee ..... A41D 27/085 2/69
2010/0275343 A1 * 11/2010 Gibson ..... A61M 16/0683 2/209.13
2010/0313334 A1 * 12/2010 Moy ..... A42B 1/248 2/209.13
2011/0094014 A1 * 4/2011 Chang ..... A42B 1/248 2/175.1
2011/0094016 A1 4/2011 Paulson
2011/0126343 A1 * 6/2011 Tualla ..... A42B 1/248 2/209.13
2011/0150558 A1 * 6/2011 Bissah ..... A61F 15/001 401/262
2011/0209261 A1 * 9/2011 Lyle ..... A63H 33/006 2/49.1
2011/0271418 A1 * 11/2011 Crockett-Grabus ..... A43B 1/0081 2/69
2012/0005809 A1 * 1/2012 Johnson ..... A42B 1/248 2/209.13
2012/0073032 A1 * 3/2012 Tigan ..... A63H 3/46 2/209.13
2012/0216336 A1 8/2012 Evans
2013/0333095 A1 * 12/2013 Dudick ..... A42B 1/205 2/209.12
2014/0193764 A1 * 7/2014 Pizzini ..... A61M 15/08 432/247
2014/0338099 A1 11/2014 Marscellas
2015/0021408 A1 * 1/2015 Matthews ..... A61L 9/127 239/34
2015/0273178 A1 * 10/2015 Johnson ..... A61M 21/02 600/27
2016/0073757 A1 3/2016 Beckerman
2016/0101139 A1 * 4/2016 Paradise ..... A61K 2300/00 424/542
2016/0106243 A1 * 4/2016 Coutu ..... A47G 21/02 30/137
2016/0128411 A1 * 5/2016 Ayres ..... A42B 1/008 2/172
2017/0245571 A1 * 8/2017 Csillag ..... A42B 1/0182
2018/0042325 A1 * 2/2018 Regan ..... A45F 3/04
2018/0343949 A1 * 12/2018 Cunliffe ..... A42B 1/006
2019/0008222 A1 * 1/2019 Afjeh ..... A41D 27/08
2019/0059815 A1 * 2/2019 Smith ..... A41D 27/08
2019/0297982 A1 * 10/2019 Denny ..... A42B 1/24
2020/0404997 A1 * 12/2020 Davis ..... A42B 1/248

FOREIGN PATENT DOCUMENTS

DE 20112685 U1 10/2002
JP H108321 A 1/1998
JP 2005220477 A 8/2005
KR 20150045966 A 4/2015
TW M263002 U 5/2005
WO 2016032112 A1 3/2016

(56) References Cited

FOREIGN PATENT DOCUMENTS

OTHER PUBLICATIONS

Hativity. "Instagram post." Apr. 21, 2017. 1 page.
Ahalife. "Herbal Sinus & Migraine Cap." https://web.archive.org/web/20140602084043/http://www.ahalife.com/product/149000000530/herbal-sinus-migraine-cap. Jun. 2, 2014. 3 pages.
Hatjoy. "Interchangeable emoji hats." https://www.producthunt.com/posts/hatjoy. 2016. 3 pages.
Voodoo Tactical. "Voodoo Tactical Contractor Baseball Cap w/Flag." https://www.amazon.com/Voodoo-Tactical-Removable-Velcro-Patch/dp/B004ULJC4A. Date first available: Mar. 31, 2011. 8 pages.

* cited by examiner

INTERACTIVE THERAPEUTIC HEADWEAR

CROSS-REFERENCE TO RELATED APPLICATIONS

This application claims priority to U.S. provisional patent application with Ser. No. 62/866,502, which was filed Jun. 25, 2019. This and all other extrinsic materials discussed herein are incorporated by reference in their entirety. Where a definition or use of a term in an incorporated reference is inconsistent or contrary to the definition of that term provided herein, the definition of that term provided herein applies and the definition of the term in the reference does not apply.

FIELD OF THE INVENTION

The field of the invention is interactive and therapeutic headwear devices, kits, and methods.

BACKGROUND

Headwear has certain functionalities, including protection, warmth, and/or style. Many people wear hats and other headwear intermittently throughout the day, taking them on and off repeatedly. When headwear is not in use and the wearer is out and about, it generally needs to be carried around. This can be a significant inconvenience as headwear is often bulky, rigid, subject to damage if carried in a purse or backpack, and/or unable to fit into compact spaces. Further, headwear can be uncomfortable to wear for long periods of time, especially for children, and there is a temptation to take them off when the wearer feels that the discomfort outweighs the benefits the hat provides.

Thus, there is a need for improved headwear with functionalities beyond protection, warmth, and style to increase its wear time and usefulness.

SUMMARY

The present invention is directed to an interactive therapeutic device for wear on a head of a user comprising an outer surface with one or more attachment points having fastener component(s) such as a hook or loop or a snap component. The interactive device also comprises one or more patches or other accessories that include fastener component(s) complementary to the attachment points' fastener components, and can removably fasten with the outer surface of the device. Some devices may additionally or alternatively comprise attachment point(s) having fastener component(s) on an inner surface, for example, where the inner surface folds over to be an outer surface, and/or on an inner surface (bottom surface) of a brim.

The headwear disclosed herein is advantageously customizable, interactive, therapeutic, and can serve multiple other purposes. Chief among the purposes are communication, entertainment and therapeutic intervention for children and adults. The interactive therapeutic headwear and associated patches and accessories can further be used to protect the head and ears of the wearer, and/or can be used for decorative/styling purposes.

The patches can include a modular patch comprising a set of patch portions that releasably fasten to one another, for example, like a puzzle. Additionally or alternatively the patches can include a puff material that absorbs and releases an aromatic oil, which can be squeezed to release scent when there is an unpleasant scent or the wearer experiences anxiety. Additionally or alternatively the patches can include a crinkle material, a squeaker, or a bell that can be used to promote a rhythmic white noise sound to stimulate and/or calm the auditory nervous system. Additionally or alternatively the patches can comprise at least one of chenille, felt, faux leather, corduroy, elastane, fleece, felt, batiste, brocade, crepe, denim, flannel, interlock, jersey, satin, taffeta, tweed, velvet and wool to provide accessible and different tactile textures to calm the wearer.

The inventive subject matter also comprises kits comprising the headwear described herein and an interactive booklet comprising fastener components such that the patches can be removably fastened to the pages of the booklet. Sets of patches may also be separately provided and may have different themes such that the headwear can be customized in new ways.

The inventive subject matter further comprises a method of interacting with a person through an interactive therapeutic device for wear on a head of a user. The method comprises providing the device to the person, wherein the device comprises an outer surface with a first hook or loop attachment point, and providing a set of patches to the person, wherein each patch of the set of patches comprises a hook or loop material and removably fastens with the first hook or loop attachment point, and wherein each patch includes a communication symbol that the person can select to convey at least one of a need and an emotion. The removable patches can be placed on the hat's communication surface (e.g., an outer surface) with images conveying a feeling of smiling, laughing, crying, sadness, love and/or fear, and/or self-help images showing food (e.g., to convey hunger), a drink (e.g., to convey thirst), a need for help, a toilet (e.g., to convey a need to go to the bathroom) and/or a band aide (e.g., to convey an injury). Such devices, kits and methods can provide improved access for someone with a disability or monolingual to engage in conversation with others.

Other advantages and benefits of the disclosed system and methods will be apparent to one of ordinary skill with a review of the following description.

BRIEF DESCRIPTION OF THE DRAWINGS

The details of embodiments of the present disclosure, both as to their structure and operation, can be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent that those skilled in the art will be able to understand the disclosure without these specific details. In some instances, well-known structures and components are shown in simplified form for brevity of description. Some of the surfaces have been left out or exaggerated for clarity and ease of explanation.

The present disclosure is directed to customizable, interactive, therapeutic headwear that can serve multiple purposes. Such purposes can include, among other things, communication, entertainment, protection, warmth, styling, and therapeutic intervention for children and adults. Headwear is an effective medium for temporary need and use depending on the situation. Unlike standard clothing that is more difficult to don and doff, certain forms of headwear (e.g., a ball cap) are easily worn or removed. The headwear may be devised in a variety of styles and can be fitted or decorated with any number of patches. As used herein, the term "patch" should be interpreted broadly to include any object (e.g., patch, accessory) that includes a fastener component complementary to a fastener component of an attachment point of headwear of the inventive subject matter.

The interactive therapeutic headwear can also be used as a portable customizable treatment option for children and adults with Autism and sensory integration (processing) disorder. Providing a variety of portable treatment options that can be easily adjusted and changed to the individuals needs in a given situation or circumstance.

Figure 1:
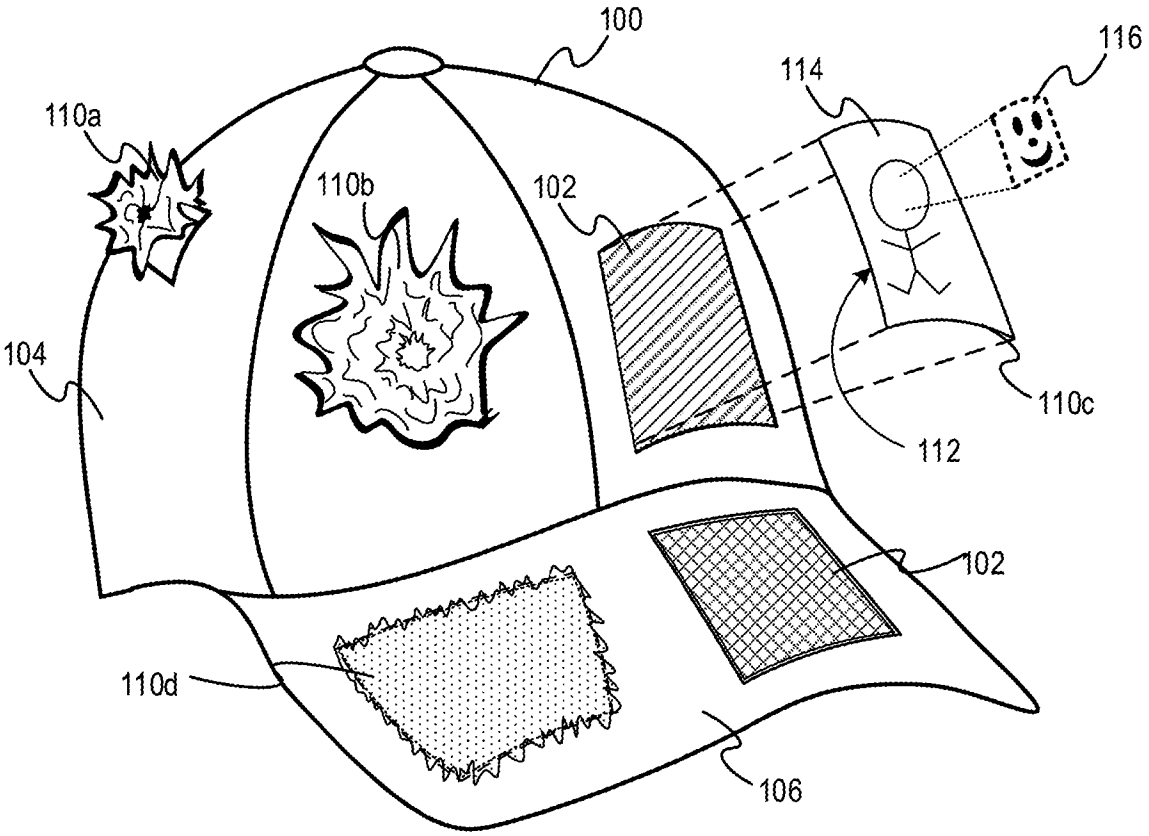
FIG. 1 illustrates an embodiment of interactive therapeutic hat of the inventive subject matter.

FIG. 1 illustrates an exemplary interactive therapeutic hat 100 having a plurality of attachment points 102. The hat 100 is shown as a ball cap, but one of ordinary skill should appreciate that the headwear can comprise any style of hat, visor, headband, hair tie, hair bow, or other item wearable on a user's head.

The hat 100 can have any suitable number of attachment points 102, for example at least 1, at least 2, at least 3, at least 4, at least 5, at least 6, at least 7, or 8 or more attachment points. The attachment points can be positioned on any portion of the headwear, including a central brim portion, a non-central brim portion, along a perimeter of a hat body, on one or more panels of the hat body, or any other suitable position(s). Each of the attachment points 102 can include a fastener component and receive a patch 110. Patches 110*a*, 110*b*, 110*c*, 110*d* are shown and can be collectively referred to as patches 110. The patches 110 can have a patch attachment 112 (also referred to herein as a fastener component) that can couple to the attachment point 102. The attachment points 102 can be distributed about the hat 100 on a hat body 104 or on an upper or lower surface of a brim 106. The attachment points 102 can be distributed symmetrically around the hat body 104 or the brim 106. The attachment points 102 can also be randomly placed on the hat body 104 or the brim 106.

In some embodiments, the attachment points 102 fastener components can be a portion of hook-and-loop style material, a snap, button or other type of connection. The patch attachment 112 can be a complementary portion of such a connection, such as the complementary portion of a snap or the loop side of a hook-and-loop fastener, if the preferred attachment point 102 is the hook side, for example.

The patches 110 can have a patch body 114 or any suitable size and shape. For example, the patch body 114 may comprise a circle, oval, square, rectangle, triangle, an irregular shape, and may be flat or 3-dimensional. Where a patch comprises an object such as a football, the patch (or patch body) can be shaped similarly to a football and be 3-dimensional, or can comprise a 2-dimensional image of the football. The patch body 114 of, for example, the sensory patches, can have a width of approximately two or more inches. Smaller patches having dimensions of less than two inches, less than one and a half inches or even less than one inch are also possible, given the size of the headwear. The width and height of the patch 110 can also proportionally increase with larger size headwear. Each sensory patch 110 can be an identifiable item or concept such as letters, numbers, shapes, animals, vehicles, seasonal items, words, characters, sports equipment, and the like.

In some aspects, one or more of patches 110 can be a modular patch, having multiple smaller pieces 116. The modular patches can comprise a variety of individual units that together create an identifiable item or concept. Thus, the patch 110 can have several subparts that come together to create the character or item. For example, a person riding a bike: the modular patch 110 can have the subparts of a bike and a person that attach together and then can be mounted to the attachment point 102. The modular pieces (e.g., eyes, nose, mouth, ears and glasses that can attach to a face) can also be subpart used to create a face, for example. It is contemplated that a modular patch can comprise any suitable number of subparts that removably couple to one another to form a unitary patch that removably couples to an attachment point 102. For example, a modular patch can comprise between 2-20 subparts, between 2-15 subparts, between 2-10 subparts, between 2-5 subparts, between 3-10 subparts, or between 3-8 subparts.

The patches and modular subparts can be designed to include different materials and fabrics to create a variety of textures and noises. The textures and noisemaking components may include: crinkle plastic/paper, squeakers, bells, hook and loop, smooth, rough, soft, hard, abrasive, angular, bendable, pliable, bristly, bubbly, bushy, coarse, cushioned, elastic, embossed, embroidered, feathery, filmy, fluffy, fuzzy, grooved, grainy, granular, flexible, rigid, jagged, pointed, prickly, spikey, knitted, layered, metallic, reflective, glossy, shiny, mushy, slimy, ornamented, padded, puff, pleated, pocked, ribbed, shaggy, sleek, silky, sheer, sparkling, spongy, stubbly, stamped, think, thin, wavy, wool, woven, patterned, embellished, chenille, felt, faux leather, corduroy, elastane, fleece, felt, batiste, brocade, crepe, denim, flannel, interlock, jersey, satin, taffeta, tweed, velvet and wool. The patches and subparts may be durable and suitable for washing, or may be for one time use (e.g., bubble wrap patches that include polyethylene film with a shaped side bonded to a flat side to form air bubbles that can be popped).

In some embodiments, an optional aromatherapy absorbent puff patch can be adapted for some styles of headwear. The aromatherapy puff patch can have of a piece of absorbent material such as feathers, cotton, fleece, synthetic fibers and the like, and may be configured to be compressed and released. In some aspects, the puff patch may be repeatedly compressed to less than 80%, less than 70%, less than 60%, less than 50%, or even less than 40% or less than 30% of its non-compressed thickness. Aromatic oil can be applied to the absorbent surface of such a patch. The patch can then be placed on a pre-determined front position on the hat, or the locations of the attachment points 102. Where the oil is placed on the puff patch, the user can compress the puff patch when desired to release the oil to the surface of the material or to the user's fingers as desired rather than reapplying oil for each use. For example, the puff patch can comprise an opening that extends from the surface of the patch to a mid-portion of the patch's thickness. This opening can be used to place essential oils into the mid-portion. Throughout the day, a wearer could squeeze the puff material in order to move the oils from the mid-portion through the puff material towards the outer surface. The puff material can comprise any suitable thickness, including for example, between 1 mm-1 inch, between 1 mm-2 cm, between 0.5 cm-2 cm, between 1-2 cm, or between 0.5 cm-1.5 cm. In some puff material patches, a central portion of the puff material patch may have a thickness that is greater than the rest of the puff material patch.

One of more of the patches may be coupled to the headwear via a hook and loop fastener (or other temporary fastener such as snaps) and also via stitching or adhesive or other permanent or temporary fastener. For example, a patch may be stitched to the headwear along an edge of the patch, and a surface of a patch may include a hook or loop fastener that removably couples with a hook or loop fastener of an attachment point of the headwear. This would allow a user pull and press on the hook and loop fastener repeatedly without losing the patch. As another example, a patch may be coupled to the headwear along an edge of the patch via a set of snaps, and a surface of a patch may include a hook or loop fastener that removably couples with a hook or loop fastener of an attachment point of the headwear. This would allow a user pull and press on the hook and loop fastener repeatedly while a portion of the patch remains coupled to the headwear via the snap fastener.

Figure 2A:
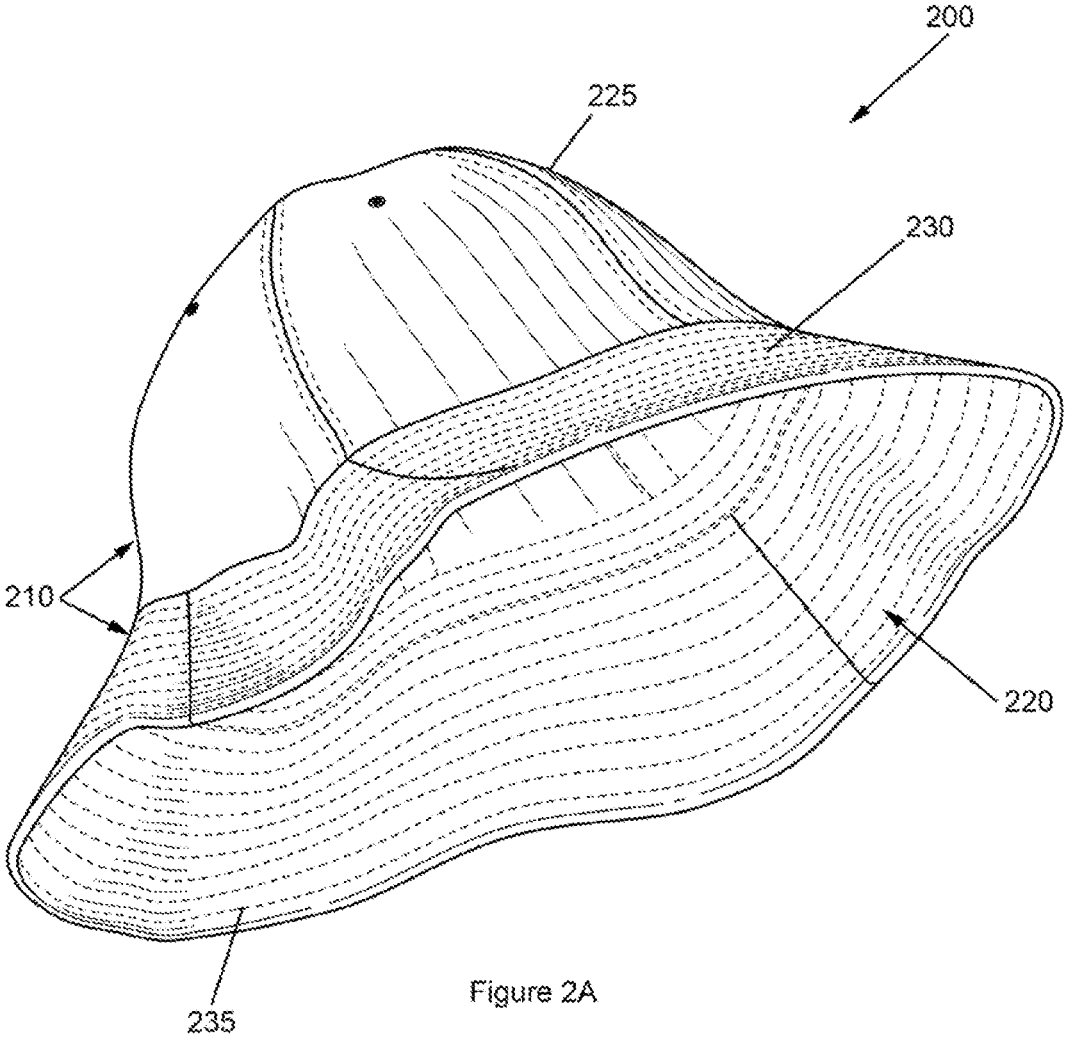
FIGS. 2A-2H illustrate a sun cap with a semi-rigid brim for use with patches of the inventive subject matter.
Figure 2B:
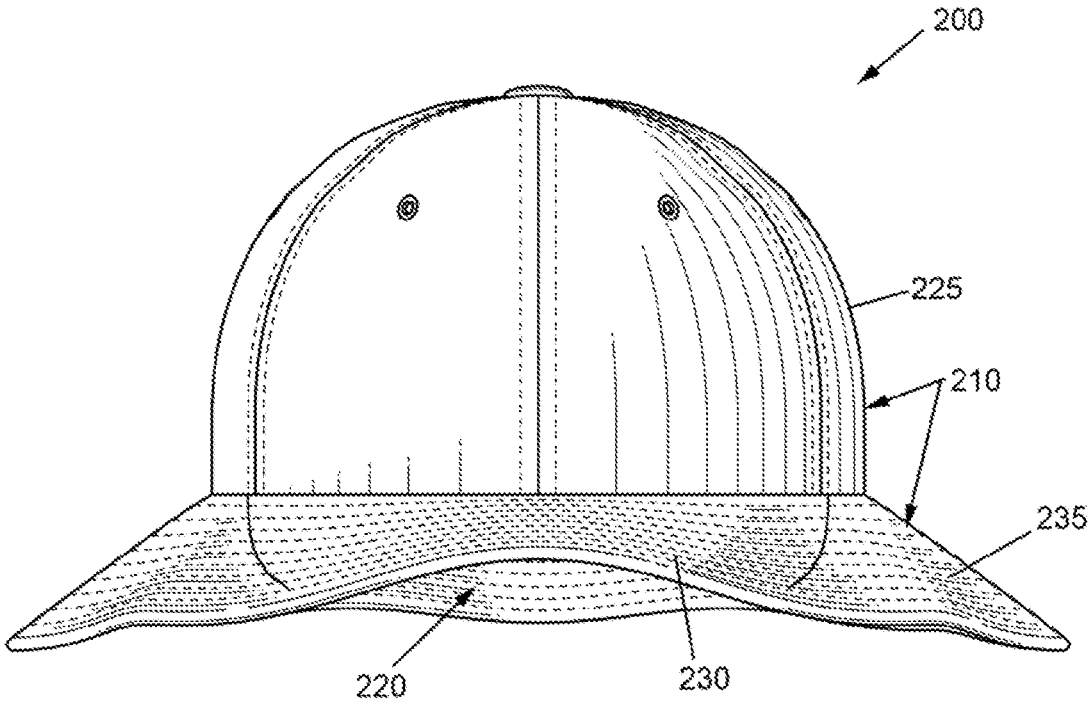
Figure 2C:
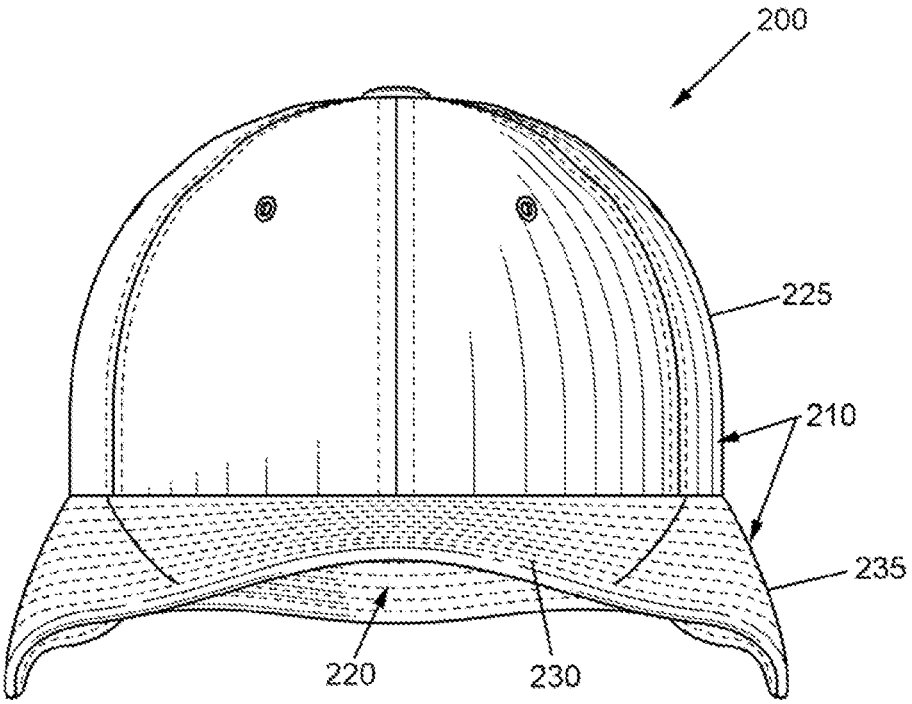
Figure 2D:
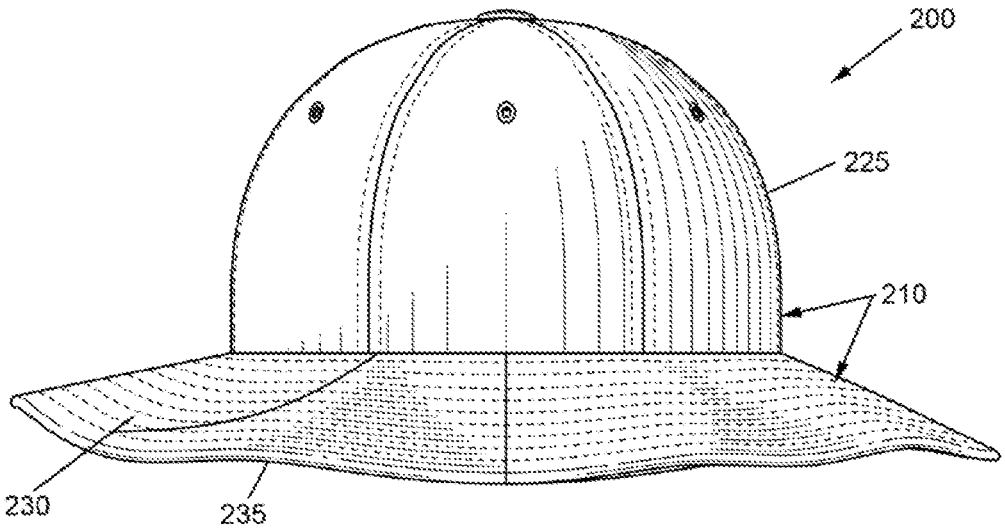
Figure 2E:
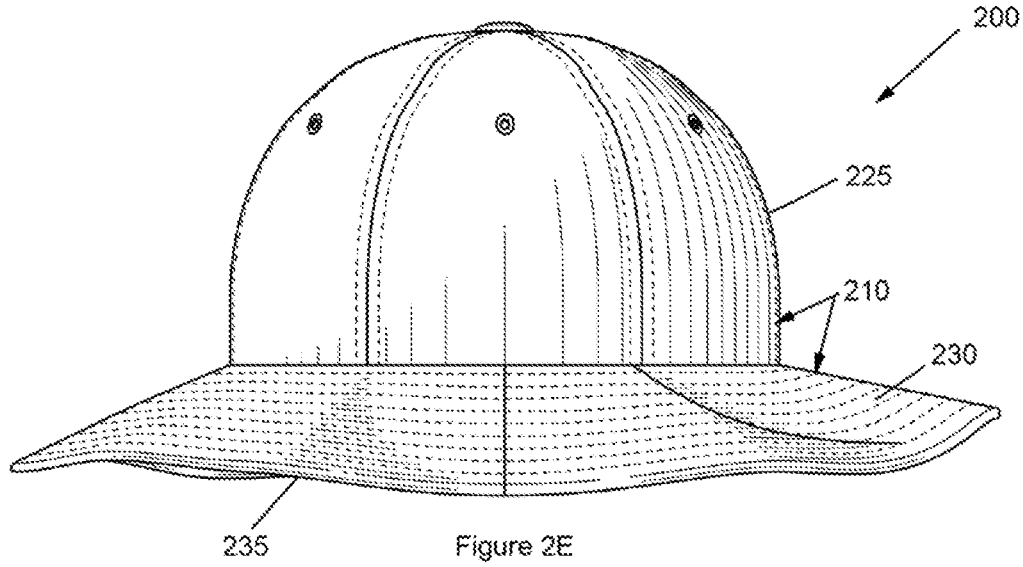
Figure 2F:
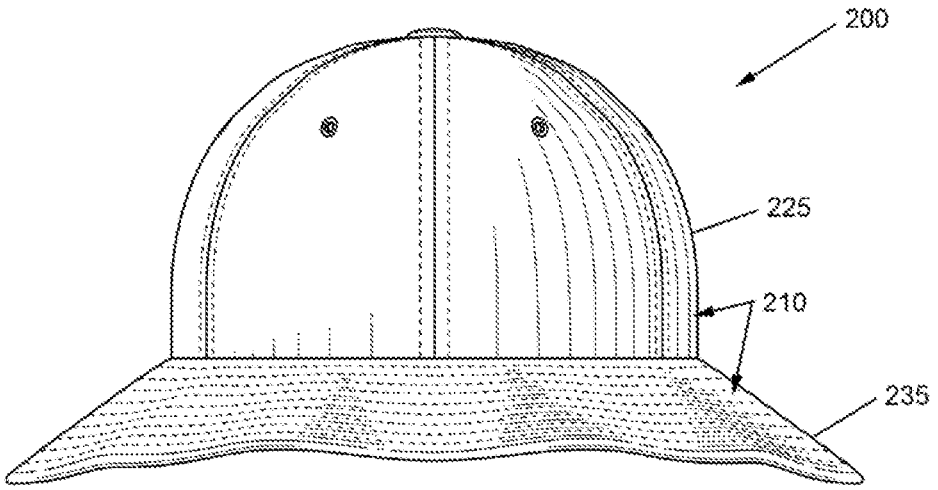
Figure 2G:
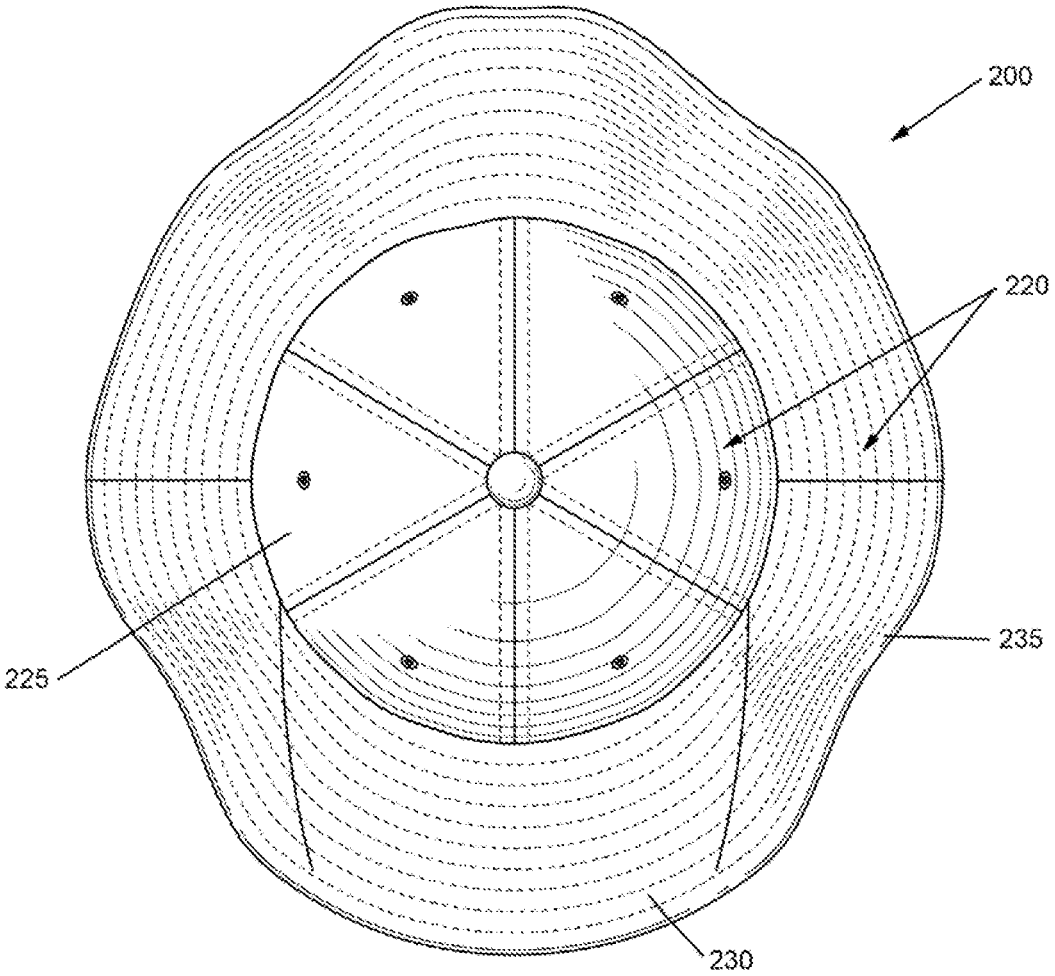
Figure 2H:
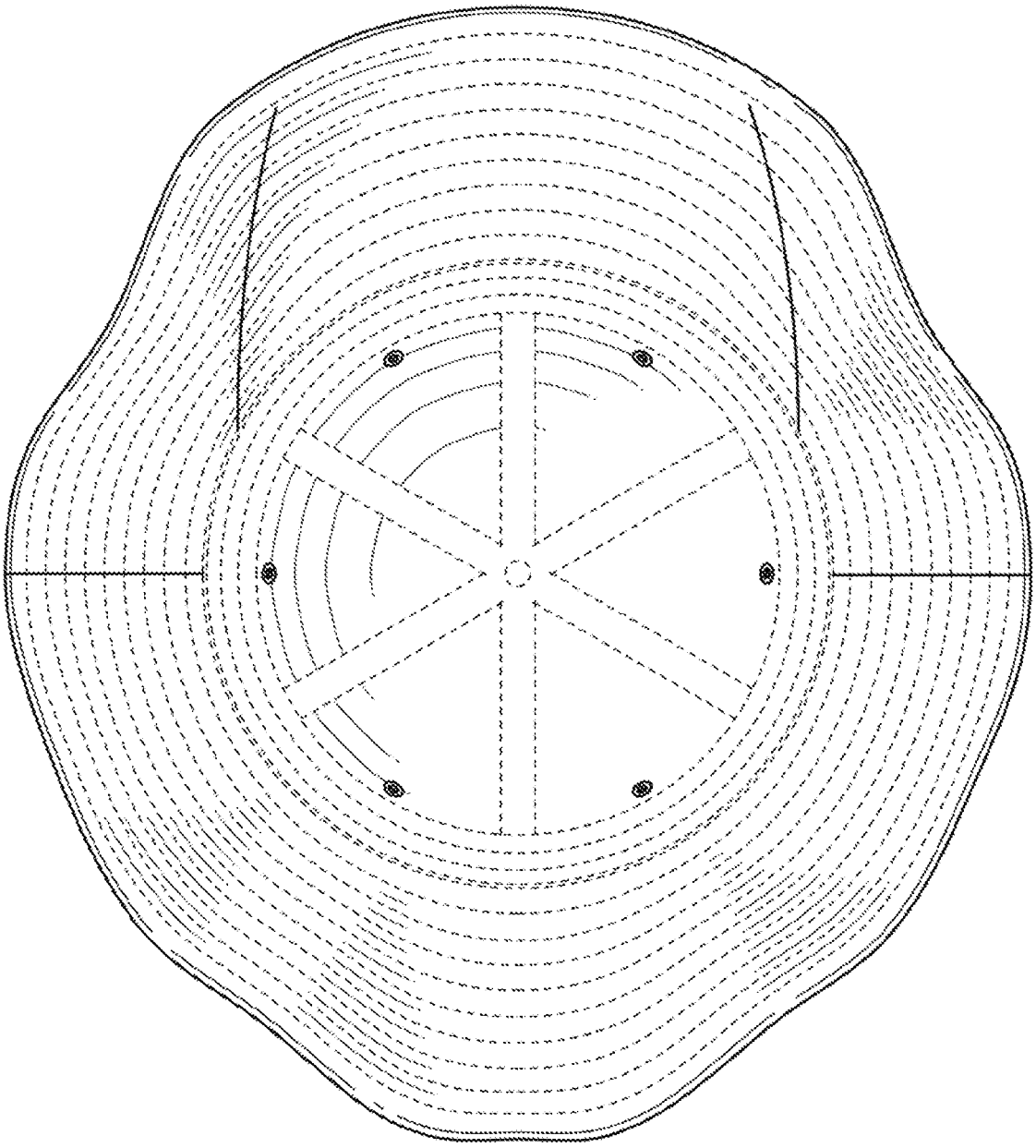

FIGS. 2A-2E illustrate an exemplary sun cap 200 of the inventive subject matter comprising an outer surface 210 (which could include a set of attachment points, not shown), an inner surface 220 (which could include one or more attachment points, not shown), a hat body 225, a semi-rigid brim portion 230, and a non-rigid brim portion 235. FIG. 2A is a perspective view of sun cap 200 with a semi-rigid brim portion for use with the patches and attachment points of FIG. 1. FIG. 2B is a front view of sun cap 200 with a semi-rigid brim portion with the sides of the non-rigid brim portion extended. FIG. 2C is a front view of sun cap 200 with a semi-rigid brim portion without the sides of the non-rigid brim portion extended. FIG. 2D is a left side view of sun cap 200 with a semi-rigid brim portion. FIG. 2E is a right side view of sun cap 200 with a semi-rigid brim portion. FIG. 2F is a rear view of sun cap 200 with a semi-rigid brim portion. FIG. 2G is a top view of sun cap with a semi-rigid brim portion. FIG. 2H is a bottom view of sun cap 200 with a semi-rigid brim portion.

Sun cap 200 can advantageously have a semi rigid brim portion, supported by stiff fabric or a solid reinforcing layer. The reinforcing layer is indicated in the figures by a pair of curved lines, showing the outer limits of the reinforcing layer. The reinforcing layer can be plastic, cardboard or any other suitable rigid or semi rigid material as needed to create a semi rigid or rigid brim portion. The semi rigid brim portion and the solid reinforcing layer can comprise any suitable width (e.g., between 1-6 inches, between 1-5 inches, between 3-8 inches, between 3-10 inches) depending on the type of hat, size of hat, or any other factor. The semi rigid brim portion provides structure to the headwear and keeps the semi rigid brim portion from flopping down to the wearer's face, similarly to a semi rigid brim of a baseball cap. The remaining portions of the hat brim can be manipulated as needed for specific circumstances. For example, the non-rigid brim portion 235 can comprise two or more layers of a fabric material. Where desired, a wire or other component that allows a user to shape the non-brim portion 235 can be included in between the layers of fabric material or one any surface of the fabric material(s) (e.g., to allow a change between the configurations shown in FIGS. 2B and 2C to be kept in place). In some embodiments, the wire or other component may extend between the hat body and the outer edge of the brim. In some embodiments, the wire or other component may extend along a portion of an outer edge of the brim. In some embodiments, the wire or other component may extend along a portion of an edge where the hat body and the brim meet. In some embodiments, the wire or other component may extend along any suitable combination of the hat body, the edge where the hat body and the brim meet, the non-rigid brim portion, the semi-rigid brim portion, and an outer edge of the brim.

Figure 3:
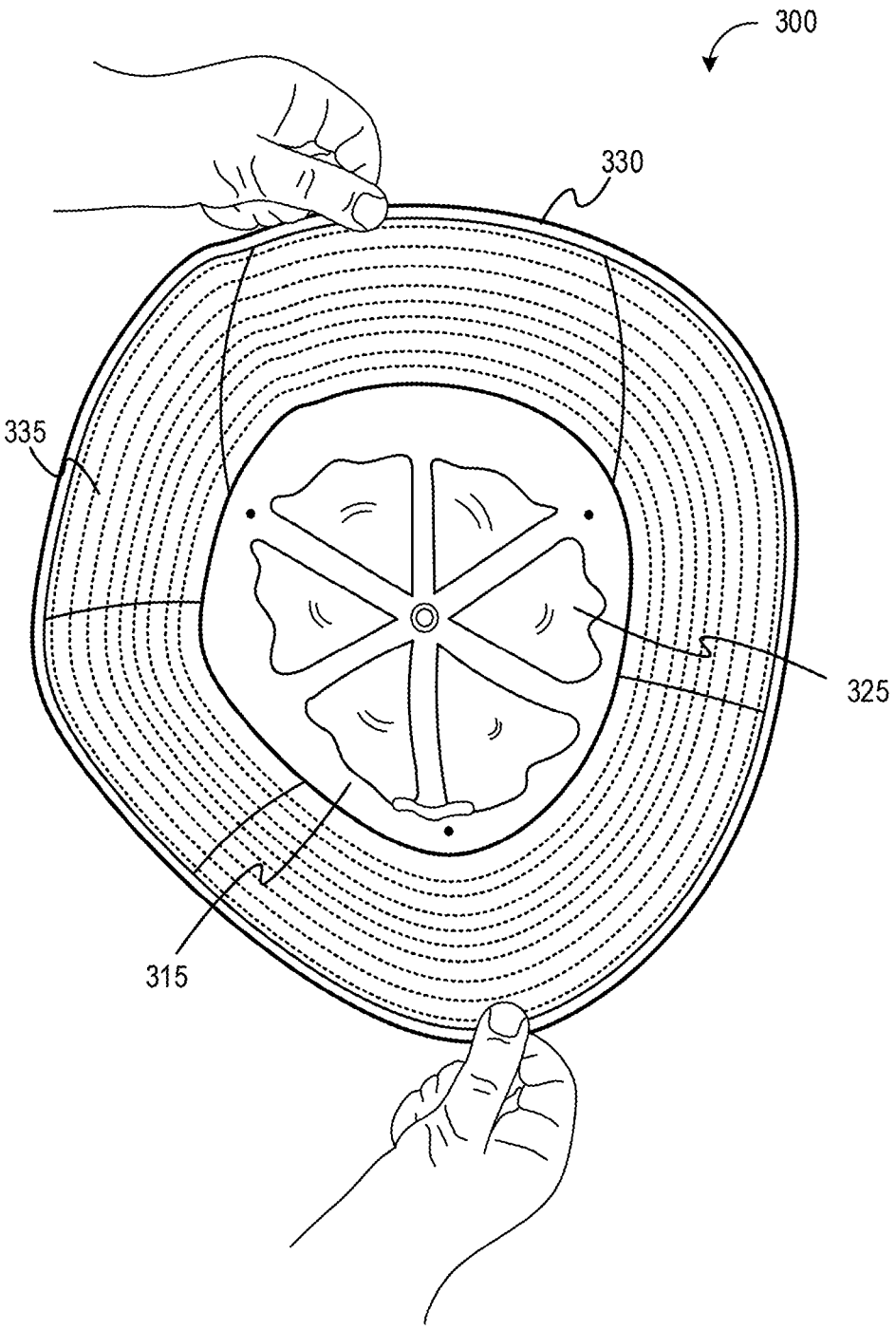
FIG. 3 illustrates an inner surface of a hat of the inventive subject matter having an elastic band.

FIG. 3 is a bottom view of an alternative sun cap 300 with a semi-rigid brim of the inventive subject matter. Sun cap 300 comprises an inner side (shown) including an elastic band 315. The elastic band 315 may be positioned on the hat body, the brim, between the hat body and the brim, and/or between at least a portion of the hat body 325 and at least a portion of the brim (semi rigid brim portion 330, non-rigid brim portion 335). Elastic band 315 can advantageously ensure proper fit and secure the hat on the head. A soft and plush elastic band covered with non-stretch nylon or other material may also provide a soft compression force to the head allowing for increased tactile stimulation, which can produce a calming and comforting effect. The compression may also lead to less medications or self-abusive interactions. The elastic band may be a complete loop or may comprise an elastic band material that extends only partially around the hat and the wearer (e.g., along 10-90%, along 10-80%, along 10-75%, along 10-60%, or along 100% of the opening sized and dimensioned to receive a wearer's head).

Figure 4:
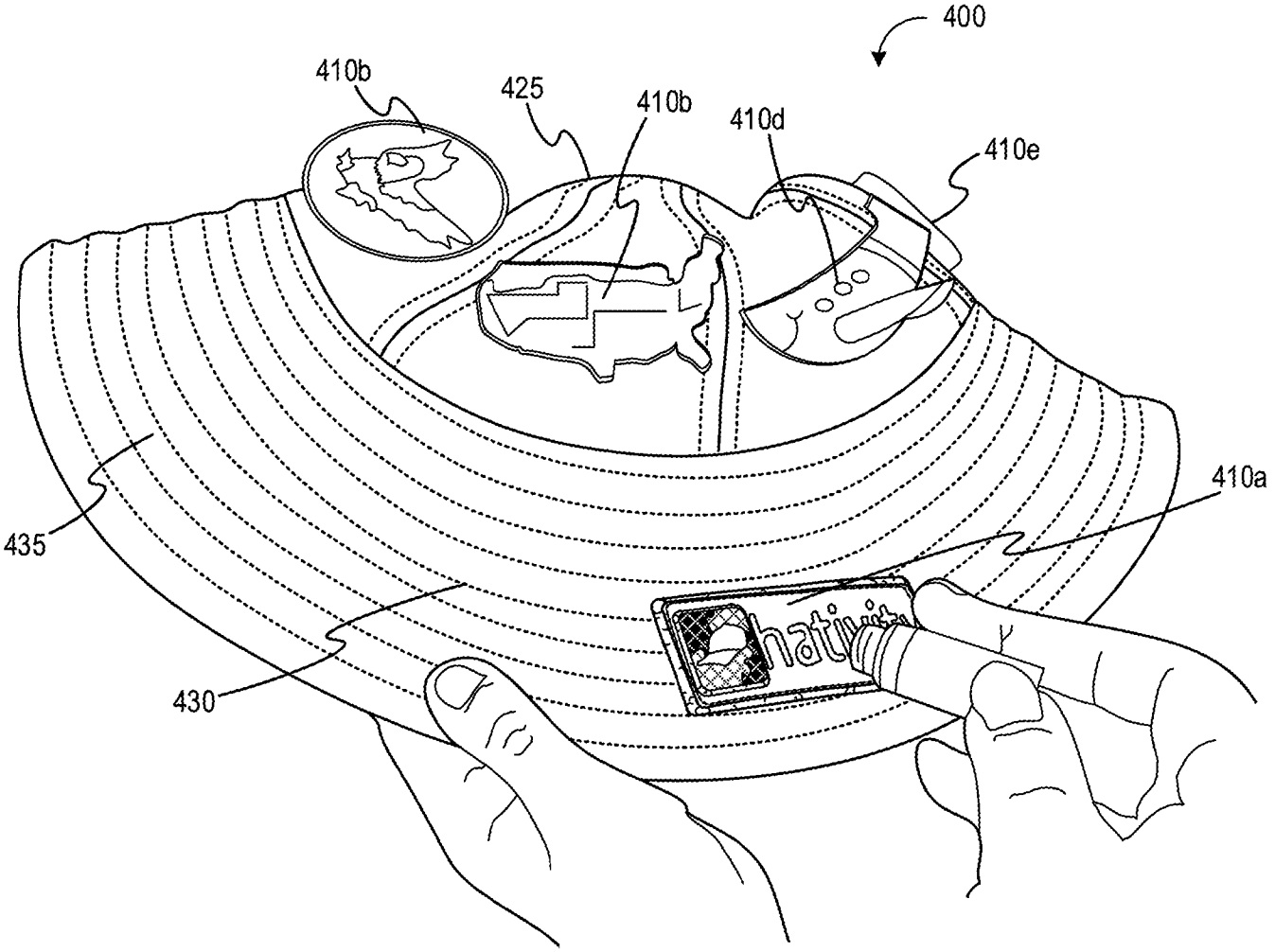
FIG. 4 illustrates a front perspective view of another embodiment of the inventive subject matter comprising a sunhat.

FIG. 4 illustrates another interactive therapeutic hat of the inventive subject matter. Hat 400 comprises a hat body 425, which is sized and dimensioned to receive a portion of a wearer's head, a brim comprising semi rigid or rigid brim portion 430 and non-rigid brim portion 435, and a plurality of patches 410*a*-410*e* removably fastened to different portions of hat 400. In the example shown in FIG. 4, a user is applying an aromatherapy oil to a rectangular patch positioned on a central brim portion.

It should be appreciated that a semi rigid brim portion (or rigid brim portion) and non-rigid brim portion can appear to be the same, and can be made of the same piece of visible material(s). For example, an entire brim can comprise a nylon and/or cotton fabric, and a semi rigid brim portion can be made semi rigid via a plastic piece that is shaped similarly to a brim of a baseball cap and secured between two or more layers of the fabric. The terms semi rigid, rigid and non-rigid are relative. Thus, a brim comprising a semi-rigid portion and a non-rigid portion comprises a $1^{st}$ portion that is more rigid than a $2^{nd}$ portion of the brim. For example, the entire brim can comprise fabric and the semi rigid brim portion can comprise a plastic piece. Preferably the semi rigid portion comprises at least 5%, at least 10% or even at least 20% of the brim. As discussed above, the non-rigid portion can comprise a wire or other component that makes it bendable while holding a shape.

FIGS. 5A-5E illustrate another embodiment of headwear for interactive or therapeutic purposes comprising a foldable beanie not including a brim that extends away from the wearer's head. Beanie 500 can comprise a hat body 510, a foldable ear covering component 520, and optionally an elastic band 525 that provides a snug and/or compressed fit as described above in connection with FIG. 3. Although the elastic band 525 is shown on a bottom edge of ear covering component 520, it should be appreciated that the elastic band 525 can be positioned along any portion of the beanie 500, including for example, the hat body 510, a mid-portion of ear covering flap 520, between hat body 510 and ear covering flap 520, and/or any other portion of the beanie 500.

The beanie 500 can include a set of attachment points (e.g., 535*a*-535*f*) that are configured to removably fasten with a set of patches (e.g., 540*a*-540*b*) in a variety of areas covering the outer surface of the beanie cap, and optionally the inner surface. The attachment points can be placed in a variety of positions on the headwear including the top, sides, back, front, brim, ear panels or any other portion of the device depending on the style and size of the headwear.

The foldable ear covering component 520 is a flap coupled with hat body 510 along attachment point 530, and can be used to cover the ears to provide warmth and protection from weather elements. Ear covering component 520 can also be used to provide sound filter and reduction. The ear covering component 520 can optionally include pockets in which sound filtering/reducing material can be added (e.g., for concerts or other loud events) and positioned over the wearer's ears. For an individual with sound sensitivity, they can become startled, scared or frightened by loud or sudden noises or sounds. Ear covering component 520, when placed over the ears, can assist in reducing noises of sounds.

Figure 5A:
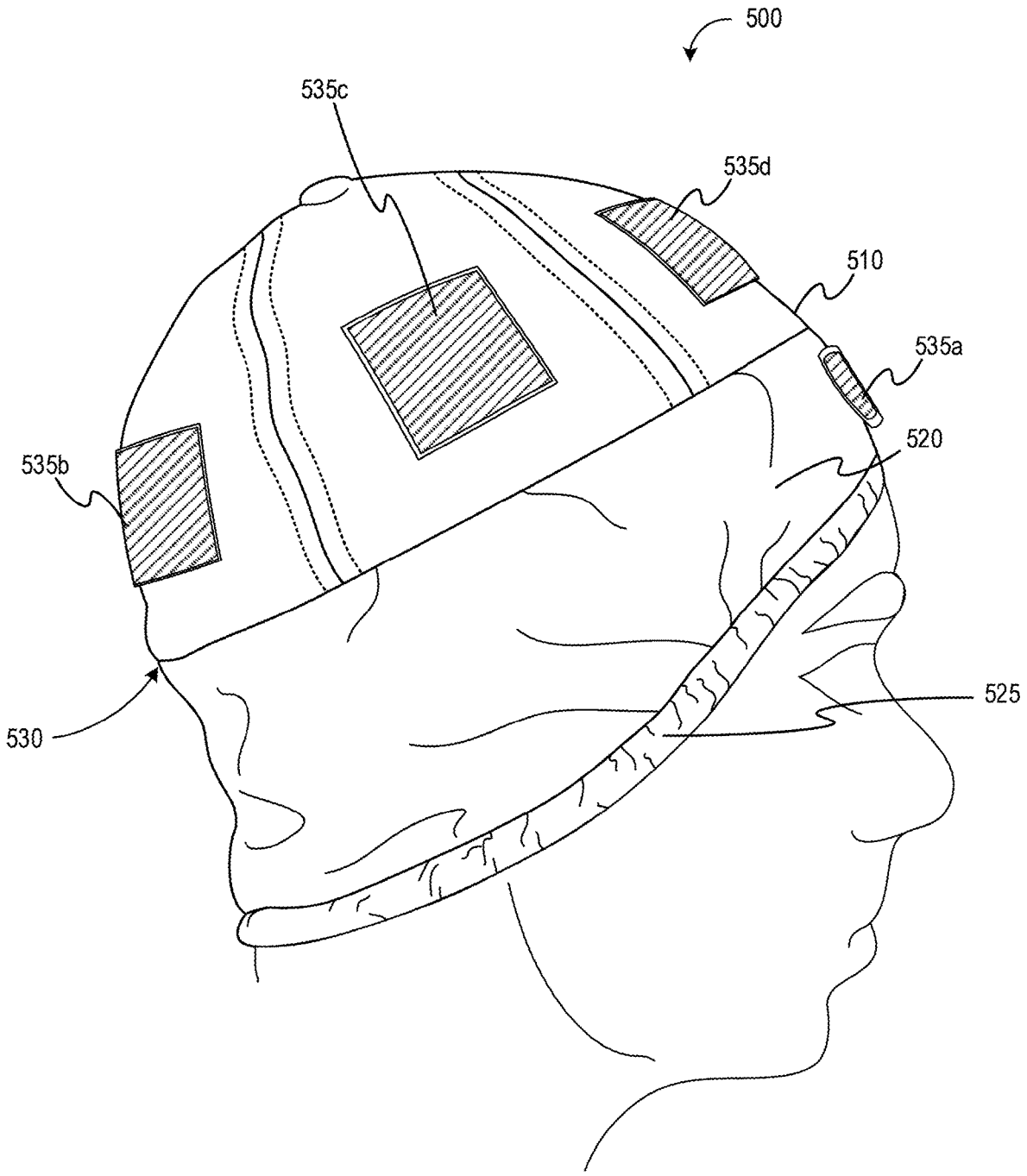
FIGS. 5A-5E illustrate another embodiment of the inventive subject matter comprising a beanie.
Figure 5B:
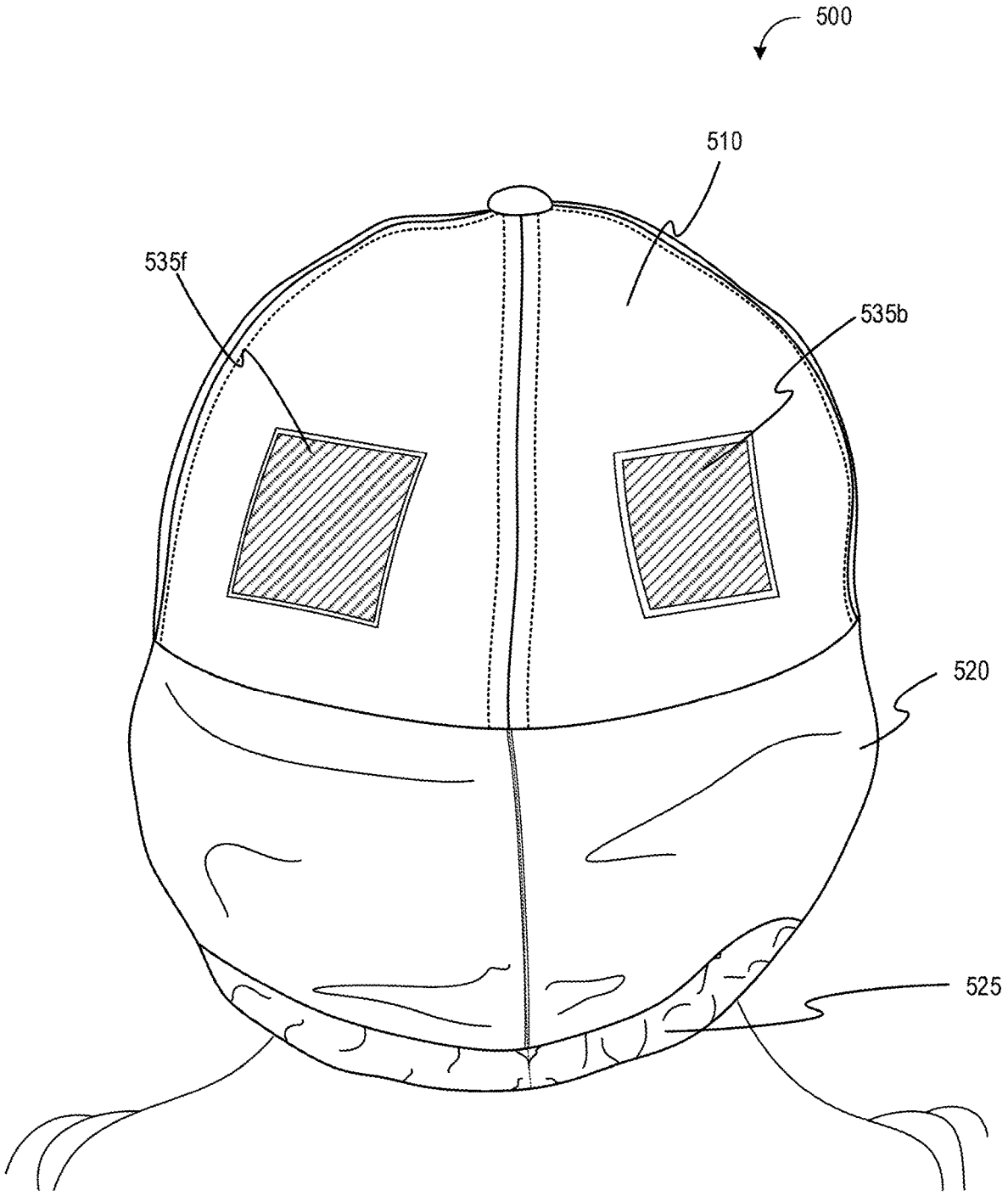
Figure 5C:
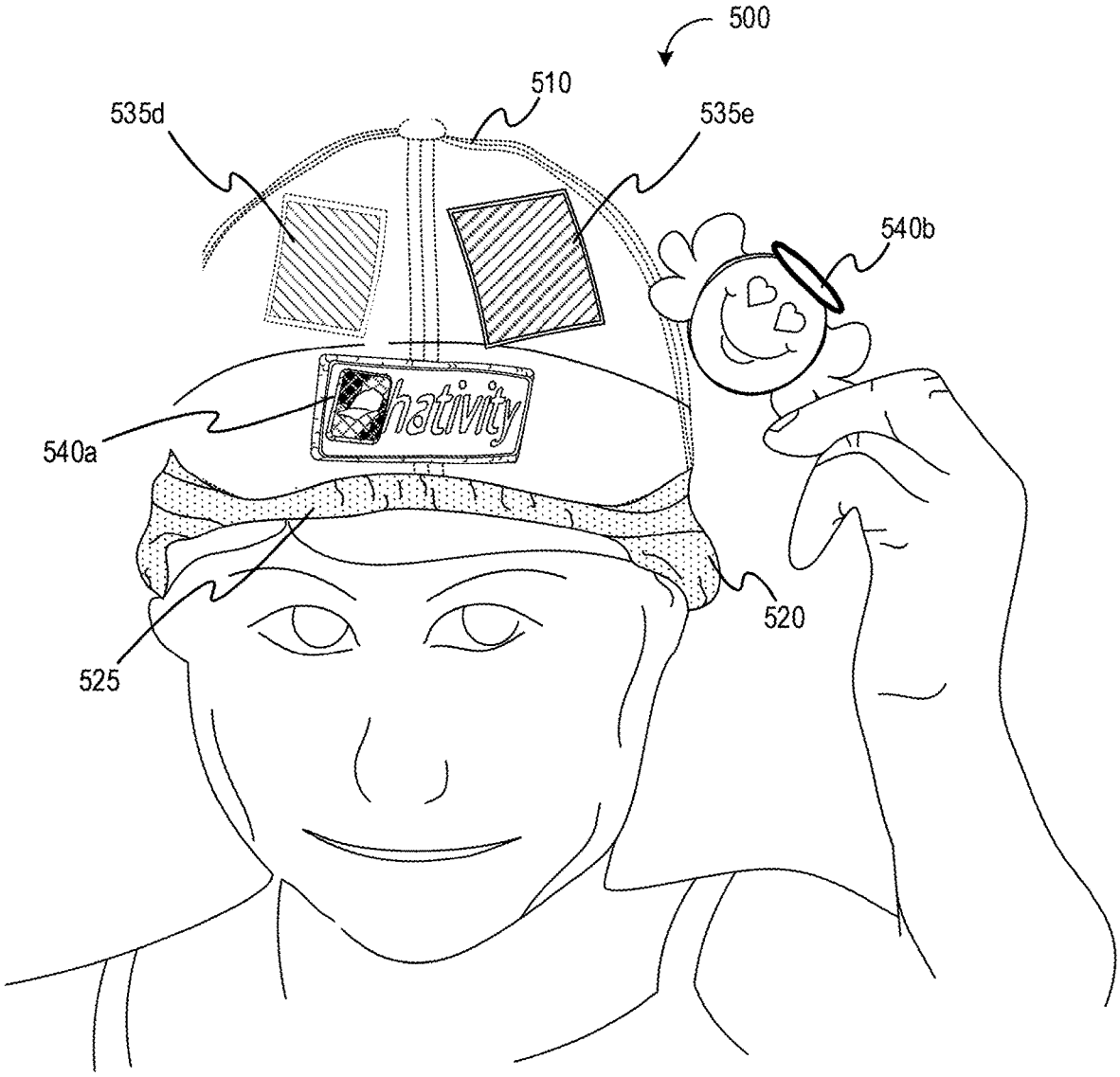
Figure 5D:
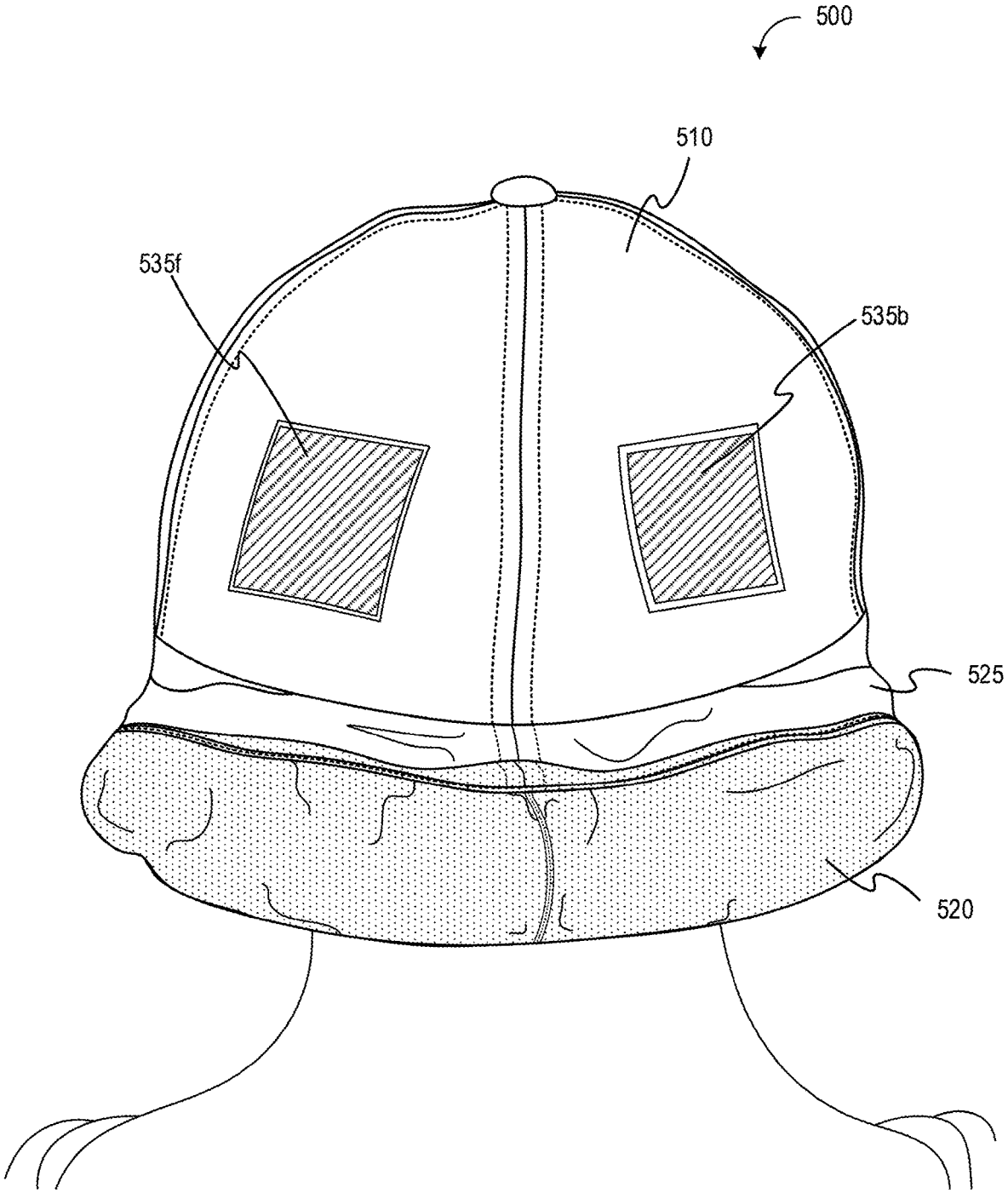
Figure 5E:
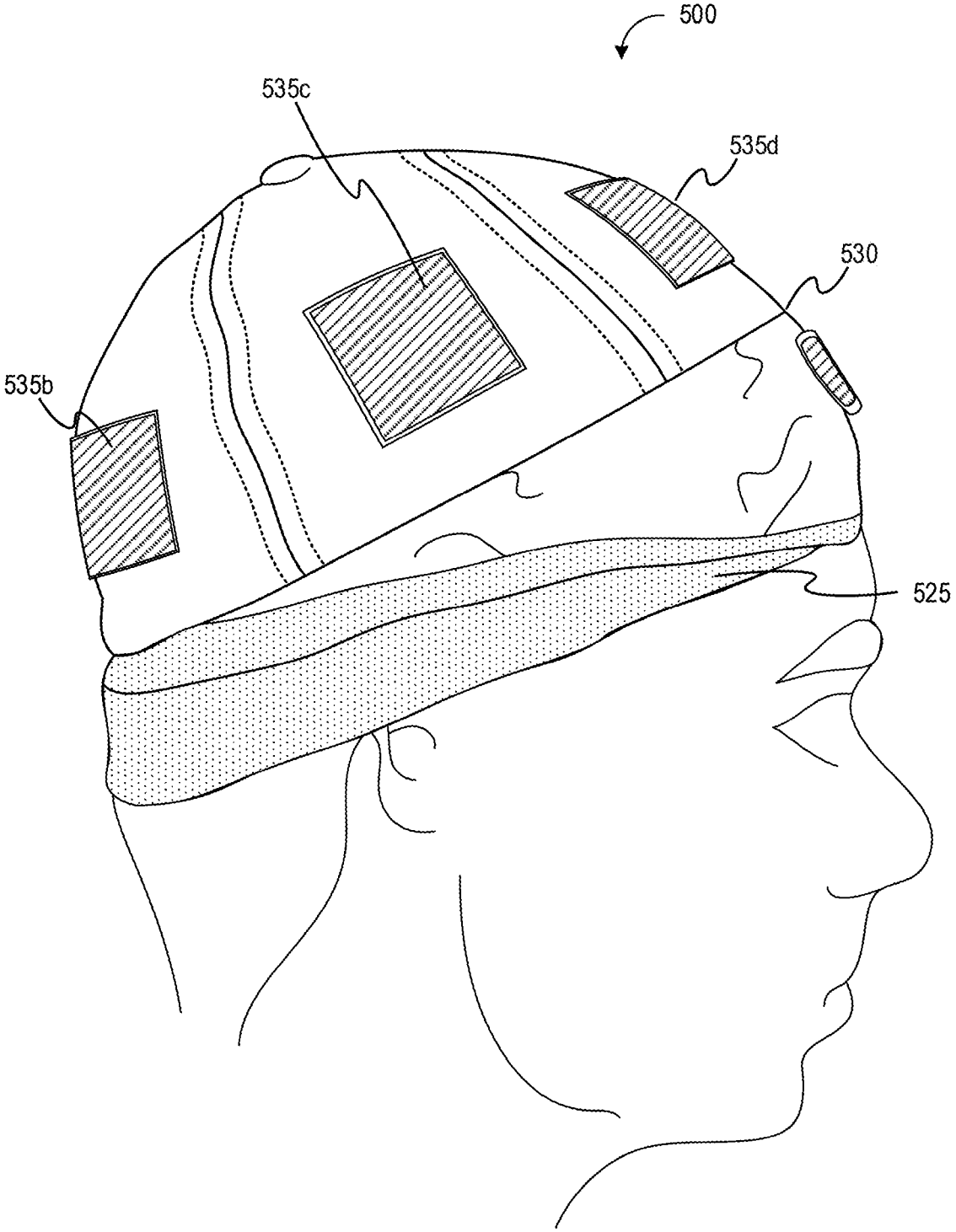

FIG. 5A is a right side view of beanie 500 on a wearer with ear covering component 520 unfolded and covering the wearer's ears. FIG. 5B is a rear view of beanie 500 on a wearer with ear covering component 520 unfolded and covering the wearer's ears. FIG. 5C is a front view of beanie 500 on a wearer with ear covering component 520 folded up partially and with patches 540*a*-540*b*. FIG. 5D is a rear view of beanie 500 on a wearer with ear covering component 520 folded up away from the wearer's ears. FIG. 5E is a right side view of beanie 500 on a wearer with ear covering component 520 partially folded up such that only a portion of the wearer's ears are covered.

Figure 6:
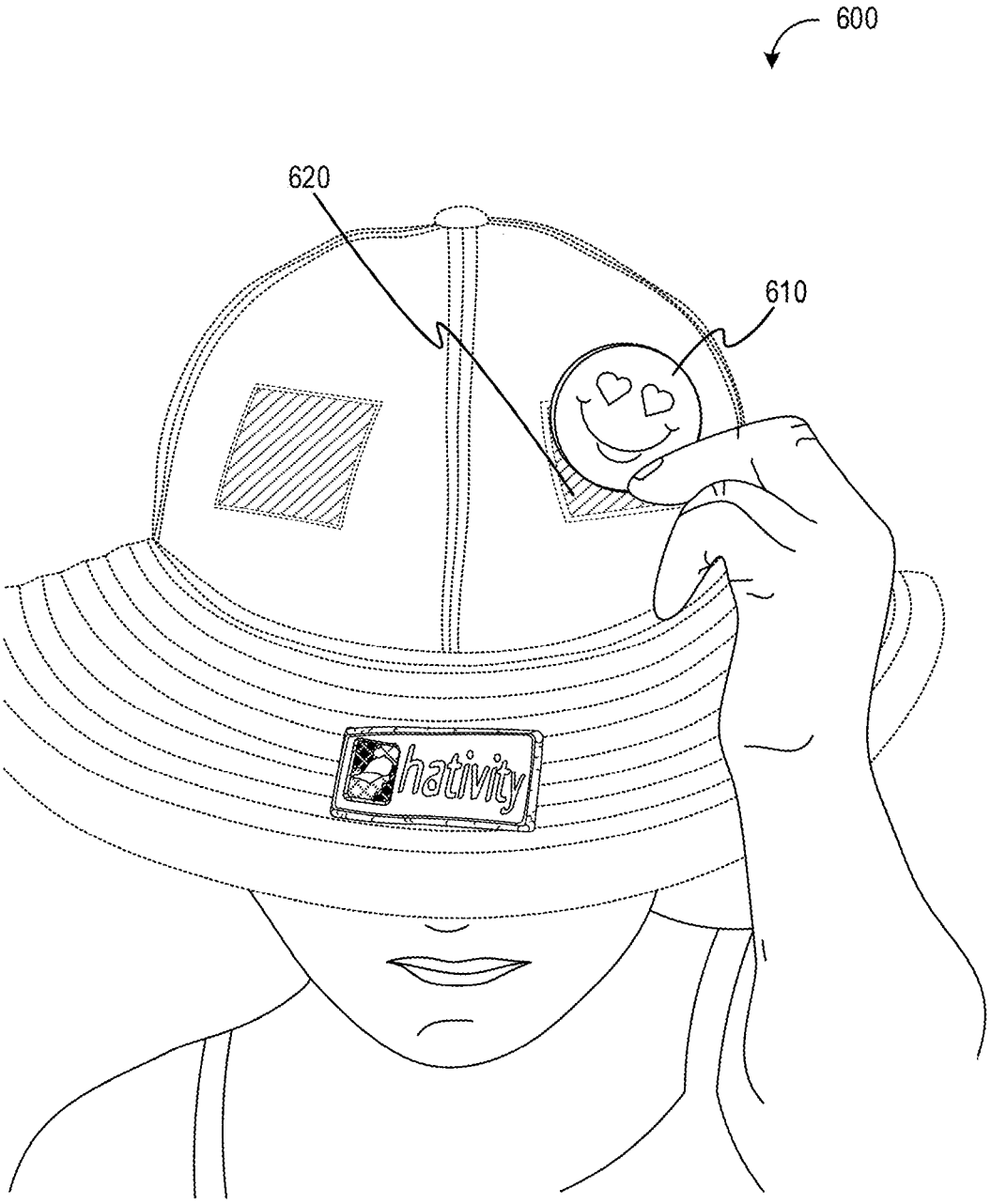
FIG. 6 illustrates another embodiment of the inventive subject matter comprising a sunhat.

The inventive subject matter also provides a method of interacting with a person through an interactive therapeutic device for wear on a head of a user. The method comprises providing the device to the person (the device being any headwear as described in this application), wherein the device comprises an outer surface with a first hook or loop attachment point. The method also comprises providing a set of patches to the person, wherein each patch of the set of patches comprises a hook or loop material and removably fastens with the first hook or loop attachment point, and wherein each patch includes a communication symbol that the person can select to convey at least one of a need and an emotion. In the example shown in FIG. 6, a wearer is placing a patch 610 having a smiling face onto an attachment point 620 of hat 600 to convey that she is happy. Other contemplated patches include faces that are laughing, crying, sad, angry, tired, fearful, and/or loving to convey an emotion, which can be used similarly to the way an emoji is used in texts to convey an emotion. Yet other contemplated patches include activity patches, which can show food to convey hunger, a drink to convey thirst, a SOS to convey the wearer needs help, a toilet to convey a need to use the bathroom, and/or a band aide to convey an injury. Such methods, devices and patches advantageous provide improved access for someone with a disability or monolingual to engage in conversation with others.

Figure 7:
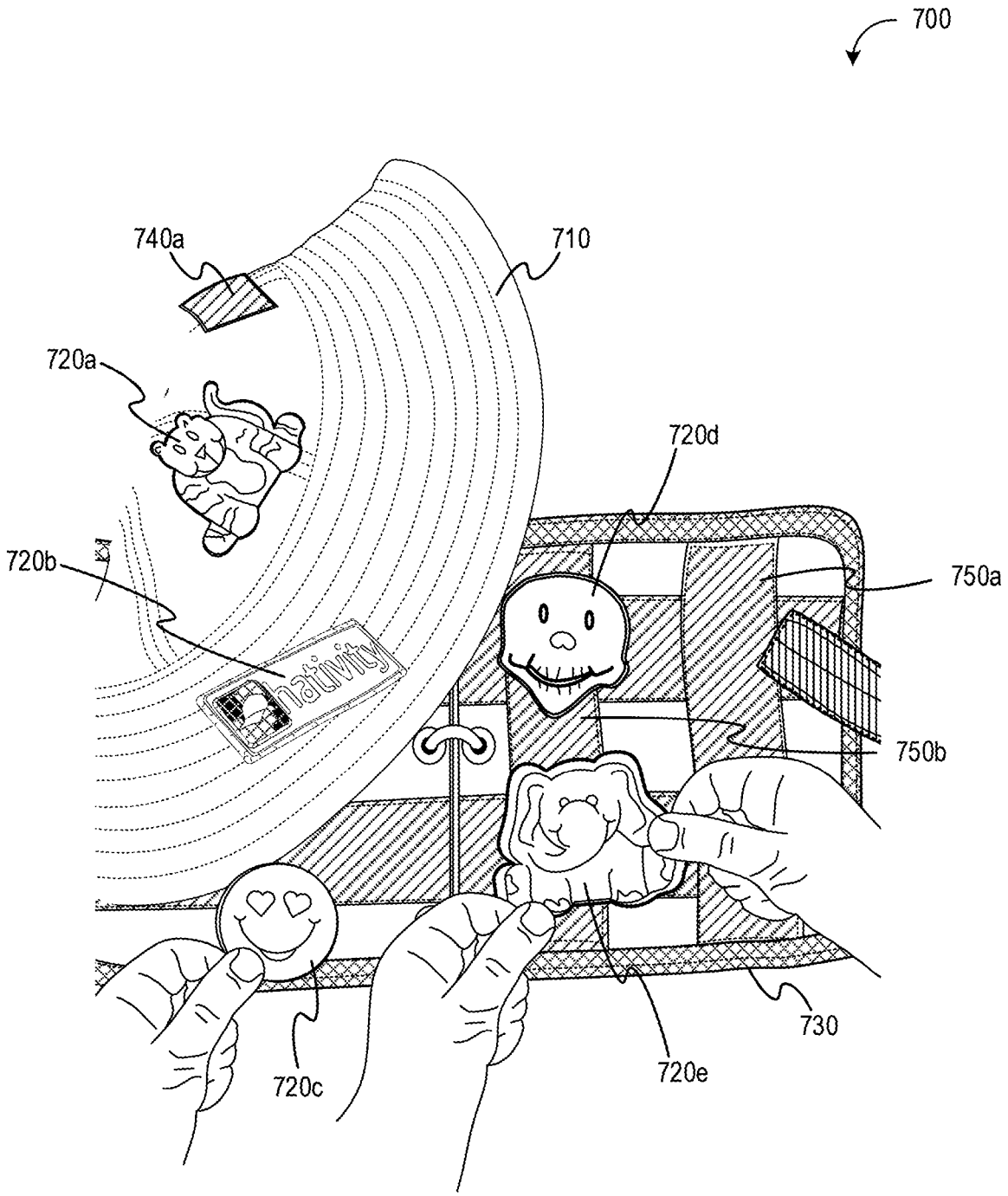
FIG. 7 illustrates an embodiment of a kit of the inventive subject matter.

The inventive subject matter also comprises kits that include headwear 710, a set of patches 720*a*-720*e*, and an activity book 730 as shown in FIG. 7. The headwear can comprise an outer surface with a first set of hook or loop attachment points (e.g., 740*a*). Each patch of the set of patches can comprise a hook or loop material and removably fastens with at least one hook or loop attachment point of the first set of hook or loop attachment points. The activity book 730 can comprise a second set of hook or loop attachment points (e.g., 750*a*, 750*b*) on different pages made of fabric or other suitable material, and each patch of the set of patches can be configured to removably fastens with at least one hook or loop attachment point of the second set of hook or loop attachment points. The patches can advantageously be placed on the headwear as well as in an accessory activity book when not worn with the headwear. Such kits can be used for role-playing, collecting and exchanging, and/or interactive storytelling and visual teaching for language development and socialization/entertainment as described herein.

Although the kits described herein are described as including hook and loop fasteners, it should be appreciated that kits of the inventive subject matter can comprise any suitable fasteners, including snap fasteners, buttons, zippers, or any other suitable fasteners.

Figure 8:
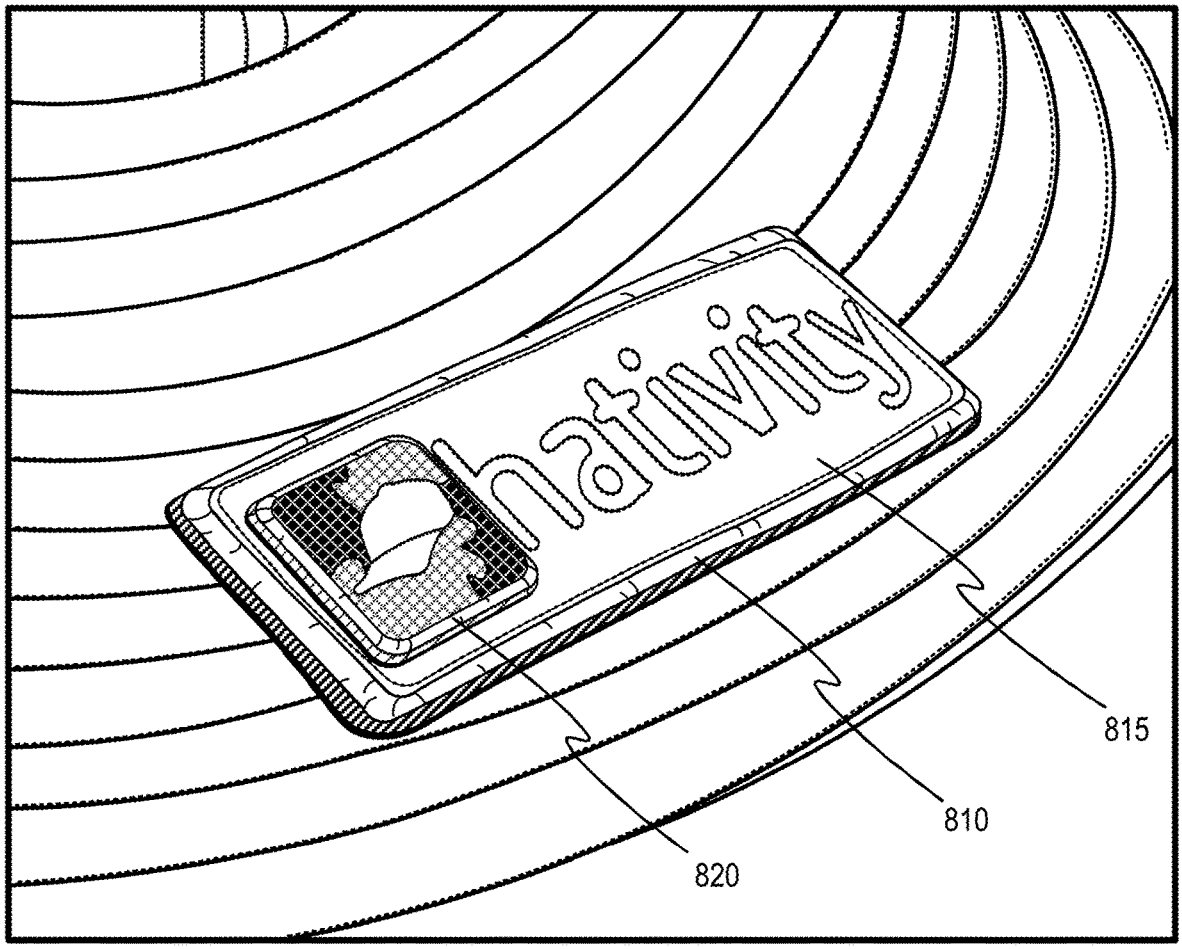
FIG. 8 illustrates an embodiment of a hat of the inventive subject matter comprising a puff material.

The set of patches can comprise any of the patches described herein, including for example, crinkle patches, bell patches, textured patches, bubble wrap patches, puff patches, character patches, and/or activity patches. FIG. 8 illustrates an exemplary patch 810 of the inventive subject matter that comprises a non-puff sub-component 815 and a puff sub-component 820. Puff sub-component 820 is thicker than non-puff sub-component 815, and is configured to receive/release aromatherapy oil. The puff sub-component 820 may be at least 150%, at least 175%, at least 200%, or at least 250% the thickness of the non-puff sub-component 815, and may be compressed to less than 80%, less than 70%, less than 60%, less than 50%, or even less than 40% or less than 30% of its non-compressed thickness.

It should be appreciated that headwear of the inventive subject matter can provide certain protective elements, such as shelter to the head and ears from weather elements (e.g., sun, wind and rain) and noise. Children often have a limited attention span and tend to remove the headwear especially when not needed for protection from weather elements. For example, a child wears a sun hat when they are outside and tends to take the hat off when indoors. Once they go inside they no longer need it and are stuck carrying it around. The interactive headwear allows for the headwear to have a dual function and to be used as a socializing activity at any time. A child can engage with his peers playing and interacting with the patches and activity book. The interchangeable and interactive design facilitates independence, learning, communication and creativity of the child. A child is able to make a choice on the sensory patches to be worn and placement of the patches. In some aspects, the different attachment points may be designated for different purposes or different levels of need. Manipulating the sensory patches promotes fine motor skills and independence. Peers using the sensory patches as toy figurines while playing facilitate socialization. The sensory patches can also be traded amongst peers to increase the variety and individuality of the headwear.

The headwear can also provide comfort or calming to the child resulting in relaxation. Children often develop a tendency for a preferred item like a stuffed animal or blanket that they carry around. This often becomes a challenge to parents and caregivers when the child misplaces the preferred item. However when a child has the interactive headwear of the disclosure, they may be comforted when holding and/or manipulating the chenille, felt, faux leather, corduroy, elastane, fleece, felt, batiste, brocade, crepe, denim, flannel, interlock, jersey, satin, taffeta, tweed, velvety texture sensory patches. Headwear is also more age appropriate then a stuffed animal or blanket for an older child and for adults.

The headwear and associated activities/mechanisms can also be used to assist with developing and normalizing an individual's visual, auditory, tactile and olfactory sensory system. For example a person diagnosed with Autism may experience increased anxiety being in the community or among unfamiliar people. However, with the interactive headwear, the individual's anxiety can be decrease in a number of ways.

Certain patch accessories with absorbent puff material for the interactive headwear can include various scents, or aromatherapy modules. Aromatherapy molecules enter the body through scent receptors of the olfactory system in the nose and travel to the brain and other parts of the body producing a response. The body responds to aromatherapy in a variety of way including: respiratory disinfection, decongestion, relaxation, stimulation, emotional and hormonal balance, improved digestion, improved memory, improved circulation, decreased heart rate, decreased blood pressure, decreased stress, decreased nausea, decreased muscular aches, decreased fatigue, decreased insomnia, decreased anxiety, decreased agitation, and/or decreased depression.

For example, a lavender scent can be added to an aromatherapy patch to elicit a calming response. A blend of scents may be used to decrease motion sickness while traveling in cars, airplanes and boats. Further, applying a preferred scent to a patch may also allow an individual access to unfavorably scented public places such as a bathroom without producing a gag reflex. Aromatherapy elements on the headwear patch may be in close proximity to the nose, facilitating such a result. Then if a different scent is desired, the patch can be quickly removed and replaced with a clean patch or one having a different scent, such as patchouli or mint, for example.

In another aspect of the inventive subject matter, different chenille, felt and faux leather textured patches can allow the user to rub or manipulate the patches for tactile stimulation to calm or stimulate the nervous system.

Certain individuals may be subject to certain medications making them photosensitive. Such a wearer can also get the physical benefit of wearing the sunhat so they are also receiving protection from UV rays when they are outside.

The therapeutic headwear is based on the concept of head coverings that can be applied around or on top of the head. The headwear can allow for complete and partial covering of the head and ears. For example, the headwear can be a headband, a visor, a baseball cap, a sun hat, a beanie or any other item wearable on a user's head that covers a portion or entirety of the wearer's head, ears, and/or forehead.

The therapeutic headwear and patches may be manufactured from a variety of materials including cotton, poly blend, denim, wool, bamboo or other fabric or synthetic materials. Some surfaces or materials may be light and image reflective. The headwear may have a structure that allows sensory patches and/or modular piece attachments to be affixed to the exterior of the headwear, and/or an inner surface of the headwear. In certain styles of headwear having, for example, a brim, the accessories or attachments can configured to removably attach to the top and/or underside of the brim, as desired by the wearer/user.

The sensory patches can be removably and securely affixed to the headwear surface via one or more various styles of attachment. For example, a hook-and-loop style attachment (e.g., Velcro), snaps, hooks, latches, magnets, or buttons can be used to affix the accessories. Once affixed the piece can remain attached to the headwear until physically removed. Depending on the size, position and desired use of the patches and modular pieces a combination of fasteners and multiple pieces can be used.

The interactive headwear can also be used as a communication device. Utilizing patches for essential personal items such as food, drink, help and bathroom placed on the headwear provides accessibility for a child or adult who is deaf, non-verbal or mono-lingual to communicate with others. Learning and expressing one's emotions and feelings is also a critical part of life and communication. Patches with emotions such as smiling, laughing, crying, sad, love and fear faces can help facilitate communication and interaction.

Thus, various embodiments of interactive and therapeutic headwear, kits and methods have been described. Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more.

As used herein, and unless the context dictates otherwise, the term "coupled to" is intended to include both direct coupling (in which two elements that are coupled to each other contact each other) and indirect coupling (in which at least one additional element is located between the two elements).

The recitation of ranges of values herein is merely intended to serve as a shorthand method of referring individually to each separate value falling within the range, and including the endpoints. Unless otherwise indicated herein, each individual value is incorporated into the specification as if it were individually recited herein.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "assembly," "mechanism," "element," "device," and the like may not be a substitute for the word "means." As such, no claim element is to be construed as a means plus function unless the element is expressly recited using the phrase "means for."

The accompanying claims and their equivalents are intended to cover such forms or modifications as would fall within the scope of the disclosure. The features and attributes of the specific example embodiments of the interactive headwear disclosed above may be combined in different ways to form additional embodiments, all of which fall within the scope of the disclosure.

Although the present disclosure provides certain example embodiments and applications, other embodiments that are apparent to those of ordinary skill in the art, including embodiments which do not provide all of the features and advantages set forth herein, are also within the scope of this disclosure.

What is claimed is:

1. An interactive therapeutic device for wear on a head of a user, comprising:

an outer surface;

an inner surface;

an attachment point comprising a first fastener component and positioned on the outer surface;

a first patch comprising a second fastener component that releasably fastens with the first fastener component, wherein the first patch is a modular patch comprising a set of patch portions that releasably fasten to one another; and a second patch including a third fastener component and a fourth fastener component of a second attachment point positioned on the outer surface, wherein the third fastener component releasably fastens with the fourth fastener component, the second patch comprising a puff material that is configured to absorb and release an aromatic oil, wherein the second patch comprises an opening extending from a surface of the second patch to a mid-portion of a thickness of the second patch, wherein the opening is configured to receive aromatic oil into mid-portion, wherein the second patch is configured to be squeezed to move the aromatic oil from the mid-portion through the puff material towards the surface of the second patch.

2. The device of claim 1, further comprising a third patch including a fifth fastener component and a sixth fastener component of a third attachment point positioned on the outer surface, wherein the fifth fastener component releasably fastens with the sixth fastener component, the third patch comprising a crinkle material.

3. The device of claim 1, further comprising a third patch including a fifth fastener component and a sixth fastener component of a third attachment point positioned on the outer surface, wherein the fifth fastener component releasably fastens with the sixth fastener component, and wherein a portion of the third patch is permanently attached to a portion of the third attachment point.

4. The device of claim 1, further comprising a third attachment point comprising a fifth fastener component, a fourth attachment point comprising a sixth fastener component, a third patch comprising a seventh fastener component, and a fourth patch comprising an eighth fastener component, wherein the first, third and fourth patches each releasably couple with each of the first, third and fourth attachment points via the first, second, fifth, sixth, seventh and eighth fastener components.

5. The device of claim 4, wherein each of the third and fourth patches is made of at least one of chenille, felt, faux leather, corduroy, elastane, fleece, felt, batiste, brocade, crepe, denim, flannel, interlock, jersey, satin, taffeta, tweed, velvet and wool to provide accessible and different tactile textures to calm the wearer.

6. The device of claim 4, wherein the third patch comprises at least one of a squeaker component, a bell, and a second puff material.

7. The device of claim 1, wherein the device is a brimmed hat.

8. The device of claim 1, wherein the device is a hat including an elastic band and a brim, the brim comprises a semi-rigid or rigid brim portion configured to provide structure above a wearer's eyes, and a non-rigid brim portion having material that is coupled to first and second sides of the semi-rigid or rigid brim portion.

9. The device of claim 1, further comprising a foldable flap having an inner fleece lining and outer nylon cover configured to be placed over an ear to filter and reduce noises.

10. The device of claim 1, wherein the puff material is configured to be compressed, thereby releasing the aromatic oil, wherein the puff material is compressible to at least one of less than 80%, less than 70%, less than 60%, less than 50%, even less than 40%, and less than 30% of a non-compressed thickness of the puff material.

11. The device of claim 1, wherein the second patch comprises a central portion, wherein the thickness of the second patch is greater in the central portion than a remainder of the second patch.

* * * * *